US008297410B2

(12) United States Patent
McDonald

(10) Patent No.: US 8,297,410 B2
(45) Date of Patent: Oct. 30, 2012

(54) ELEVATING WORKSHOP PIT PLATFORM

(76) Inventor: Hew Cosmo McDonald, Howard Springs (AU)

( * ) Notice: Subject to any disclaimer, the term of this patent is extended or adjusted under 35 U.S.C. 154(b) by 877 days.

(21) Appl. No.: 11/916,285

(22) PCT Filed: Jun. 2, 2006

(86) PCT No.: PCT/AU2006/000745

§ 371 (c)(1),
(2), (4) Date: Jun. 24, 2008

(87) PCT Pub. No.: WO2006/128241

PCT Pub. Date: Dec. 7, 2006

(65) Prior Publication Data

US 2009/0166131 A1 Jul. 2, 2009

(30) Foreign Application Priority Data

Jun. 2, 2005 (AU) ..... 2005902843

(51) Int. Cl.

| | |
|---|---|
| ***B66B 9/02*** | (2006.01) |
| ***B66B 11/04*** | (2006.01) |
| ***B66B 9/04*** | (2006.01) |
| ***B66F 7/12*** | (2006.01) |
| ***E04H 6/16*** | (2006.01) |

(52) U.S. Cl. ..... 187/250; 187/253; 187/213; 187/215; 187/272

(58) Field of Classification Search ..... 187/210, 187/215, 250, 251, 272, 266; *B66F 7/04, B66F 7/12; B66B 9/02, 9/04, 11/04; E04H 6/06, E04H 6/18*

See application file for complete search history.

(56) References Cited

U.S. PATENT DOCUMENTS

| | | | | |
|---|---|---|---|---|
| 4,747,242 | A * | 5/1988 | Aarstad | 52/174 |
| 6,446,757 | B1 * | 9/2002 | Taylor | 187/208 |
| 7,143,869 | B1 * | 12/2006 | Chance | 187/208 |
| 2008/0121853 | A1 * | 5/2008 | Schultz et al. | 254/264 |
| 2009/0321189 | A1 * | 12/2009 | Schmitt | 187/215 |

FOREIGN PATENT DOCUMENTS

| | | | |
|---|---|---|---|
| DE | 7025482 | | 10/1970 |
| DE | 3129675 | A1 * | 2/1983 |
| DE | 19620796 | | 11/1997 |
| EP | 787870 | A1 * | 8/1997 |
| EP | 1473269 | | 11/2004 |
| EP | 1473269 | A1 * | 11/2004 |
| FR | 2576298 | A1 * | 7/1986 |

(Continued)

*Primary Examiner* — Michael Mansen
*Assistant Examiner* — Stefan Kruer
(74) *Attorney, Agent, or Firm* — McNeely, Hare & War, LLP; Kevin J. McNeely

(57) ABSTRACT

A pit platform (10) within a pit (11) located in a floor, having a deck (12) that can be raised and lowered by a lifting means (14) between a raised position in which the deck is substantially level with the floor and a second position in which the deck is beneath the level of the floor. The deck is supported by a plurality of cables (18) controlled by the lifting means to effect substantially vertical movement of the deck within the pit. A method of moving the deck between the raised and second positions is also described. The pit platform has particular application to a workshop, enabling workers standing on the platform to position themselves at a comfortable height below a vehicle that is being worked upon. In the raised position the platform provides a safety cover for the pit.

11 Claims, 2 Drawing Sheets

FOREIGN PATENT DOCUMENTS

| | | | | |
|---|---|---|---|---|
| FR | 2823735 | A1 | * | 10/2002 |
| GB | 2268467 | | | 1/1994 |
| JP | 57007741 | | | 1/1982 |
| JP | 57030632 | A | * | 2/1982 |
| JP | 2002037591 | | | 2/2002 |

* cited by examiner

ELEVATING WORKSHOP PIT PLATFORM

FIELD OF THE INVENTION

The present invention relates to an elevating platform for application and use in a workshop pit.

BACKGROUND TO THE INVENTION

It is known and well established practice in mechanical workshops for those who are working upon a particular machine or vehicle to position themselves underneath the machine or vehicle so as to readily access the underside thereof. Known means of attaining access to the underside of a machine generally involve either raising the machine on a hoist or the like, or the workers locating themselves in an open workshop pit over which the machine is positioned.

Each of these means has inherent disadvantages in both practical and safety aspects. For example, in instances where a heavy machine is hoisted to a level above a worker, there is always a risk that the machine or part thereof may fall and injure the worker. Also, upon hoisting a machine so as to gain access to the underside, it is no longer possible to perform work upon upper regions of the machine without first lowering the machine. Clearly, this can lead to inefficiency and lost production time.

With respect to the use of a workshop pit for positioning workers underneath a machine, there is a disadvantage in that the workers are often unable to adequately position themselves at a level that permits easy and comfortable access to the part of the machine that is being worked upon at that time. This is not only inconvenient, but also may lead to an increased possibility for injury, due to for example, the worker hitting their head on an underhanging part of the machine that is being worked upon, or falling from a stool that has been used to position the worker closer to the part being worked upon. Further, there is often a need for workers to climb out of the pit for the purpose of retrieving tools or equipment for the job at hand. This is not only inefficient in terms of time, but may also be difficult in those instances where relatively heavy or cumbersome equipment is required. Further safety issues may arise with respect to the use of a pit in a workshop floor, primarily being the need to barricade or otherwise safely cover the pit when not in use.

The present invention attempts to overcome at least in part the aforementioned disadvantages of previous means of accessing an underside of machinery and vehicles.

SUMMARY OF THE INVENTION

In accordance with one aspect of the present invention there is provided a pit platform within a pit located in a floor, characterised in that the pit platform comprises a deck in operative communication with a lifting means, wherein the lifting means enables movement of the deck between a first position in which the deck is substantially level with the floor and a second position in which the deck is beneath the level of the floor.

Preferably, the deck is supported by a plurality of cables, each cable having a deck supporting portion, wherein the length of each supporting portion is controlled by the lifting means to effect substantially vertical movement of the deck in the pit.

More preferably, the lifting means includes a ram of variable length, the ram having a first end fixed relative to the deck or the pit and a second end operatively engaged with the cables such that varying the length of the ram acts to vary the length of the deck supporting portions.

BRIEF DESCRIPTION OF THE DRAWINGS

The present invention will now be described, by way of example, with reference to the accompanying drawings, in which.

DESCRIPTION OF AN EMBODIMENT OF THE INVENTION

Figure 1:
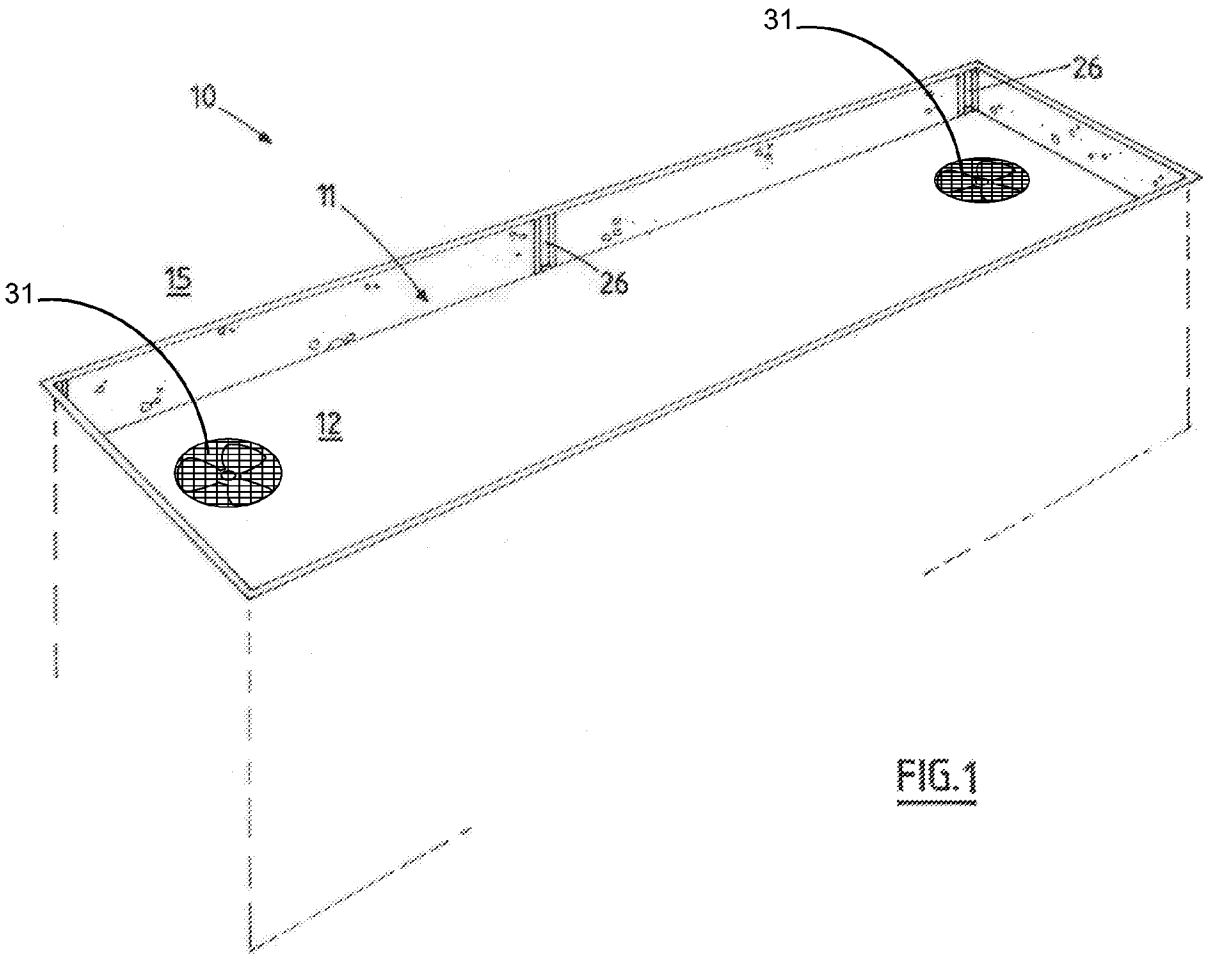
FIG. 1 is an upper perspective of an elevating workshop pit platform in accordance with the present invention.

Referring to the Figures, there is shown an elevating workshop pit platform 10 associated with a workshop pit 11 located in a workshop floor 15, the pit platform 10 including a deck 12 in operative communication with a lifting means 14. The deck 12 is substantially of the same horizontal dimensions as the workshop pit 11, such that the deck 12 is able to act as either a base or a cover of the workshop pit 11.

The deck 12 typically is comprised of one or more panels. Each panel is made of a strong and rigid material to enable the deck 12 to withstand the weight of personnel and/or machinery. The panels are secured and mounted upon a framework 13, disposed underneath the deck 12. It is preferred that each of the panels are able to be individually placed upon and removed from the framework 13 so as to allow, for example, replacement of damaged panels or to gain access to an area below the panels for maintenance or repair.

The deck 12 is able to be moved vertically within the workshop pit 11 between a first position in which the deck 12 is substantially level with the workshop floor 15 and a second position in which the deck 12 is beneath the level of the floor, preferably adjacent to a base of the workshop pit 11. The vertical movement of the deck 12 is enabled by the lifting means 14 and the deck 12 is thus also supported within the workshop pit 11 by the lifting means 14.

The lifting means 14 may comprise any suitable means of effecting substantially vertical movement of the deck 12 within the workshop pit 11. A preferred embodiment of the lifting means 14, shown in FIG. 2, includes a ram 16. Preferably, the ram 16 is a hydraulic ram. In the preferred embodiment shown in FIG. 2, the ram 16 sits substantially horizontally within the framework 13 so as to move with the deck 12 in use.

The ram 16 includes a fixed portion 21, fixed in position relative to the deck 12; and an extendible portion 20, extending outwardly from the fixed portion 21. The fixed portion 21 extends longitudinally underneath the deck 12 from an outer edge of the framework 13 and the extendible portion 20 extends from an end of the fixed portion 21 remote from the outer edge of the framework.

The extendible portion 20 may consist of a piston arrangement, known in hydraulic rams, or may include one or more elongate members, telescopically engaged with the fixed portion 21 so as to enable lengthening or shortening of the ram 16. In a preferred embodiment, the ram 16 has a length of approximately 2 metres and is extendible by at least a further 1.8 to 2 metres. However, it should be understood that the length of the ram 16 would be largely dependent on the depth and length of the pit 11.

The ram 16 further includes a cable-securing portion 22. The cable-securing portion 22 is a rigid member, disposed substantially perpendicularly to an end of the extendible portion 20 of the ram 16.

One or more cables 18 are securably attached at a first end to the cable-securing portion 22. In the embodiment shown in FIG. 2, a second end of each cable 18 is secured to a respective support post 26, preferably at an upper end thereof. Each cable 18 is attached by any suitable means, such as by a standard end anchoring device. Each cable 18 includes a deck supporting portion 19 extending between the respective support post 26 and the deck 12. In a preferred embodiment of the invention each deck supporting portion 19 engages the deck 19 by means of a respective horizontal-axis pulley 28. The pulleys 28 are mounted to the framework 13 of the deck 12 by suitable means such that the weight of the deck 12 is transferred through the pulleys 28 to the cable 18. In the embodiment of the drawings a horizontal portion of the cable 18 extends between its pulley 28 and the cable securing portion 22 of the ram 16.

It will be appreciated that the pulleys 28 may be organised in any suitable arrangement with their respective cables 18 to facilitate necessary direction changes of the cables 18 and to adequately redirect forces in the cables 18 during use of the pit platform 10.

Figure 2:
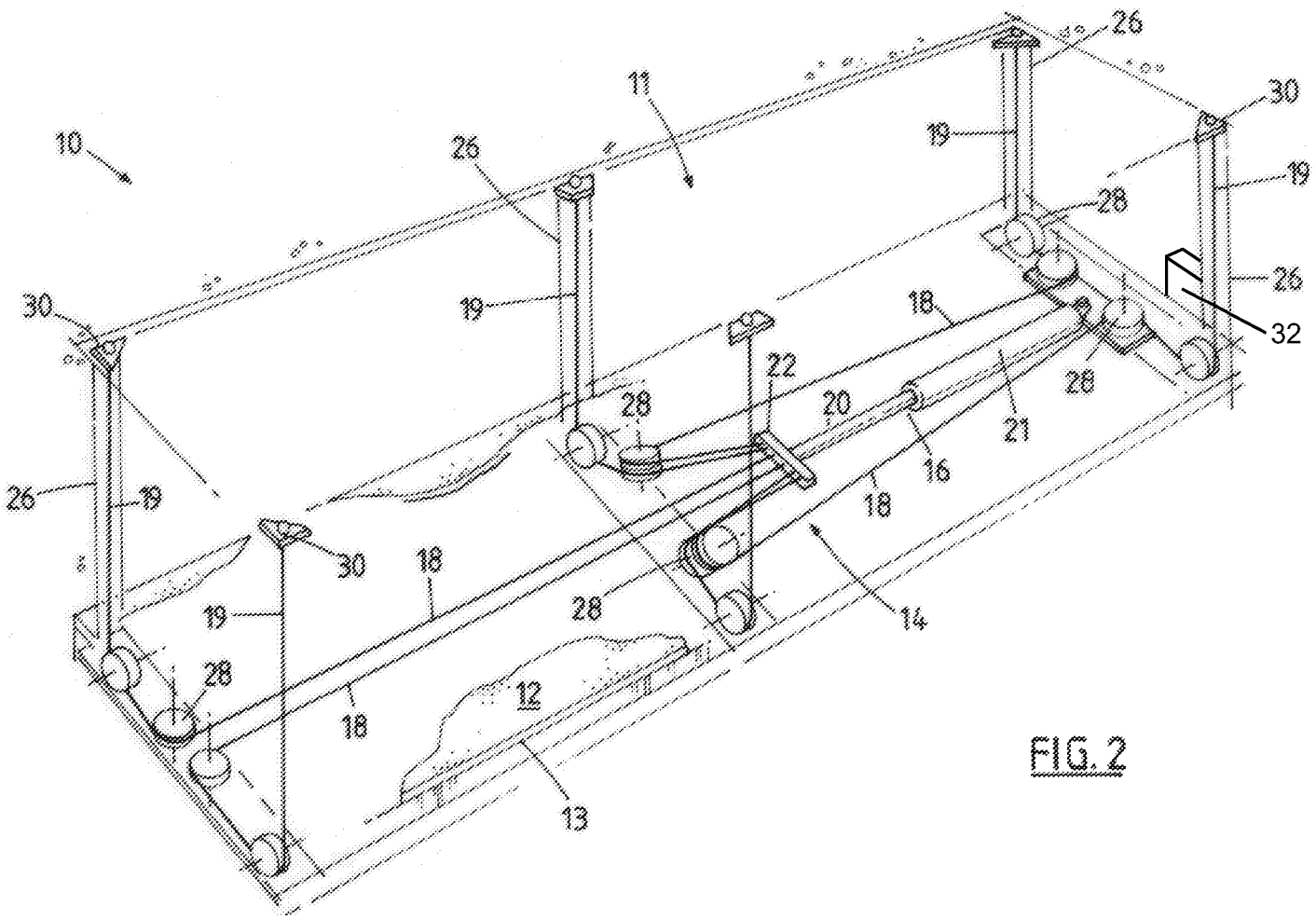
FIG. 2 is an upper perspective of the elevating workshop pit platform of FIG. 1 with a cut-away section showing a lifting means for effecting vertical movement of a deck of the workshop pit platform.

In the embodiment shown in FIG. 2, the deck supporting portion 19 runs adjacent and parallel to each respective support post 26. The length of the deck supporting portion 19 of each cable 18 is variable in response to the lifting means 14 to effect vertical movement of the deck 12 within the pit 11. In the embodiment shown, this entails alternate extension and retraction of the ram 16 to move the deck 12 between the second and first position respectively.

Preferably, each corner of the workshop pit 11 has a support post 26 securely mounted thereto. It is preferred that each support post 26 is bolted or otherwise securably fastened at least at an upper end to steady the post 26 and at a lower end for load bearing. Appropriate secure fastening of each of the support posts 26 is necessary for safety and also to ensure proper operation of the pit platform 10, as the deck 12 essentially moves vertically up and down each of the support posts 26.

In the preferred embodiment of the drawing, there are six support posts 26, there being one for each corner and a further two being located adjacent opposing walls of the pit 11. Each of the four corner support posts 26 extends substantially the full vertical height of the workshop pit 11 and is arranged in a configuration that conforms to its corner. In this respect, it is preferred that a substantially triangle-shaped cover plate 30 be arranged horizontally atop the upper end of each corner support post 26. It is preferred that the pit platform 10 be provided with safety features to limit the possibility of injury to workers. One such safety feature is the provision of guard portions (not shown), provided adjacent each corner of the deck 12. The guard portions are provided to prevent the possibility of persons catching a portion of their body, such as a toe, between the cover plate 30 and the platform 12 as the platform 12 is raised upwardly.

Each guard portion is preferably hinged to a main body of the deck 12. In this manner, each guard portion tilts upwardly from the deck 12 about the hinge when the deck 12 is located within the workshop pit 11. Upon the deck 12 reaching the first position, whereby the deck 12 is substantially level with the workshop floor 15, each guard portion is arranged to fold along its hinge, such that each guard portion is substantially coplanar with the main body of the platform 12.

In the present embodiment, operation of the ram 16 and hence the cables 18 and deck 12 are actuated by a hydraulic system. The hydraulic system may include a power pack (not shown), pump (not shown) and hoses to actuate movement of the ram 16. Although a hydraulic system is a preferred means of actuating the ram 16, it should be understood that any other actuation means such as a pneumatic system may be employed without departing from the scope of the present invention.

To this extent, it is preferred that there are further safety features specifically directed towards limiting the possibility of injury in the event of failure of functional components, such as the hydraulic system or cables 18.

The hydraulic system is preferably provided with a safety valve (not shown) that is located intermediate of the ram 16 and the hydraulic power pack. The safety valve operates such that the hydraulic system will effectively be shut down in the event, for example, one or more of the hydraulic hoses becomes loose or develops a leak. The safety valve also preferably has the capacity to ensure that pressure from the pump of the hydraulic system is required to effect both upward and downward movement of the deck 12. The safety valve is preferably set to a predetermined load capacity for the deck 12. In this manner, if the load upon the platform 12 is exceeded past that which is known to be safe, any further movement of the deck 12 will be prevented.

A further safety feature is also preferably included in the form of a limit switch. The limit switch is typically located upon the framework 13 underneath the deck 12. In the preferred embodiment, the limit switch is arranged such that it is able to detect if the deck 12 or cables 18 have moved past a setting that is known to be safe for operative purposes, for example, in the event of failure of any of these components. In such an instance, the limit switch is able to communicate to the hydraulic system or safety valve to effect a shutdown of the hydraulic system.

It is also preferred that the workshop pit platform 10 be provided with at least one ventilation means 31. The ventilation means 31 is preferably provided in the form of one or more ventilation fans. The ventilation means 31 is provided so as to prevent any build up of gas within the workshop pit 11. Accumulation of potentially explosive gasses may occur clue to the effective enclosing of the workshop pit 11 by the deck 12 when the deck 12 is in the first position.

In a preferred embodiment, at least one ventilation fan 32 is located in the framework 13. Even more preferably, there are two ventilation fans, for input and output of air respectively. In such an embodiment, at least part of the panel forming part of the deck 12 directly above each fan has apertures to allow the movement of air. For example, the panel could be a grill. It is important however, that any such grill still has sufficient strength and rigidity to allow for placement of equipment, personnel and machinery atop in normal use of the pit platform 10.

It is further preferred that the pit platform 10 has a mechanical locking means (not shown) that enables the deck 12 to be locked into position, particularly the first position where the deck 12 is level with the workshop floor, without relying on the cables 18 for support. Provision of such a locking means enables heavy machinery and the like to be placed atop the deck 12 as if the deck 12 were part of a solid workshop floor 11. Such a locking means may comprise essentially of engagement of a strong supporting member, located underneath the deck 12, into a correspondingly sized and shaped aperture in one or more walls of the pit. However, any such means that effectively locks the deck 12 in a raised position without relying on support from the cables 18 may be employed.

An operator is able to effect movement of the deck 12 via a control unit (not shown) in operative communication with the hydraulic system. Preferably, the control unit is able to communicate with the hydraulic system by a radio frequency or the like, which permits the control unit to be carried by an operator. However, the control unit may also be connected to the hydraulic system via electrical cables or the like.

The control unit is provided with at least one switch to effect movement of the deck 12. In the preferred embodiment, two switches must be activated in order to effect movement of the deck 12. A first switch effects actuation of the hydraulic system and a second switch effects upwards or downwards movement of the deck 12 within the workshop pit. Preferably, each of these switches must be activated simultaneously in order to actuate movement of the deck 12. Even more preferably, the control unit also includes an emergency switch so that the pit platform 10 may be shutdown immediately in the event of an emergency.

In use, the deck 12 typically is initially positioned in the first position, wherein the deck 12 is substantially level with the workshop floor 15. Any machinery or tools that are required for a particular task at hand are moved onto the deck 12 prior to any downward movement into the workshop pit 11.

The deck 12 is then lowered to a desired level within the workshop pit 11 by actuating an appropriate switch on the control unit. Activation of the switch effects actuation of the hydraulic system which in turn effects the movement of the ram 16. To effect downward movement of the deck 12, movement of the extendible portion 20 relative to the fixed portion 21 extends the length of the ram 16.

Extension of the length of the ram 16 moves the cable-securing portion 22 of the ram 16 generally towards a mid region of the deck 12. This movement of the ram 16 and cable-securing portion 22 acts, in the embodiment shown, to increase the length of the deck supporting portion 19 adjacent each support post 26 via the pulleys 28, thereby enabling lowering of the deck 12 towards the base of the workshop pit 11. Movement of the deck 12 may be stopped once the desired level within the workshop pit 11 is achieved.

Once the task at hand has been completed or it is generally desired to move the deck 12 upwardly, the appropriate switch upon the control unit is actuated. This in turn effects retraction of the ram 16 to effectively shorten the length of the platform support portion 19 of each cable 18. As the length of the respective platform supporting portions 19 are shortened, the deck 12 is moved upwardly until the deck 12 is substantially level with the workshop floor 15. This eliminates the necessity for any further barricading or safely covering the opening to the workshop pit 11. Modifications and variations as would be apparent to a skilled addressee are deemed to be within the scope of the present invention. For instance, it will be appreciated that the ram could be fixed relative to the pit rather than the platform, and appropriate changes made to the cable configuration, without departing from the scope of the invention.

The claims defining the invention are as follows:

1. A pit platform within a pit located in a floor, wherein the pit platform comprises:

a deck in operative communication with a lifting means for lifting of the deck between a first position in which the deck is substantially level with the floor and a second position in which the deck is beneath the level of the floor;

a plurality of cables to support the deck, each of the cables having a deck supporting portion, wherein a length of each deck supporting portion is controlled by the lifting means to effect substantially vertical movement of the deck within the pit; and more than four supporting posts;

wherein the lifting means comprises a ram of variable length, the ram being operatively attached to one or more cables, wherein variation in length of the ram causes variation in the length of the deck supporting portions, and wherein the ram sits substantially horizontally within a framework disposed underneath the deck, whereby the ram moves with the deck when in use, said ram comprising a cable-securing portion disposed substantially perpendicular to an end of an extendible portion of the ram wherein one or more cables are securably attached at a first end of the cable-securing portion and the second end of each cable is secured to one of the supporting posts.

2. A pit platform according to claim 1 wherein the length of the ram is varied by extension or retraction of an extendible portion relative to a fixed portion, the fixed portion being fixed in position relative to the pit.

3. A pit platform according to claim 2, wherein extension of the ram effects lowering of the deck within the pit.

4. A pit platform according to claim 1 wherein the deck has a ventilation means, the ventilation means being provided to prevent the accumulation of gas within the workshop pit.

5. A pit platform according to claim 4, wherein the ventilation means includes at least one fan, the at least one fan being disposed in the deck.

6. A pit platform according to claim 1, wherein the length of the ram is varied by extension or retraction of the extendible portion relative to a fixed portion, the fixed portion being fixed in position relative to the platform.

7. A pit platform according to claim 1, wherein the ram includes at east one telescoping member to enable extension and retraction thereof.

8. A pit platform according to claim 1 wherein extension of the ram effects lengthening of the deck supporting portions of the cables and retraction of the ram effects shortening of the deck supporting portions.

9. A pit platform according to claim to wherein the deck supporting portion of each cable is arranged adjacent and parallel to a respective support post, such that the deck moves substantially vertically up and down relative to the support posts.

10. A pit platform according to claim 1, wherein the more than four supporting posts comprises six supporting posts.

11. A method of moving a deck associated with a pit located in a floor between a first position in which the deck is substantially level with the floor and a second position in which the deck is beneath the floor, the deck being in operative communication with a lifting means for lifting the deck, wherein the lifting means comprises a ram of variable length, the ram being operatively attached to cables, each cable having a deck supporting portion, wherein variation in length of the ram causes variation in a length of the deck supporting portions, and wherein the ram sits substantially horizontally within a framework disposed underneath the deck whereby the ram moves with the deck when in use, said ram comprising a cable-securing portion disposed substantially perpendicular to an end of an extendible portion of the ram wherein the cables are securably attached at a first end of the cable-securing portion and the second end of each cable is secured to one of more than four supporting posts, wherein the deck is supported by the cables, and wherein the length of each deck supporting portion is controlled by the lifting means to effect substantially vertical movement of the deck within the pit, the method comprising:

actuating movement of the ram to effect variation in the length of the ram, wherein variation in the length of the ram causes variation in the length of the deck supporting portions so as to enable movement of the deck.

* * * * *